US010493641B2

(12) United States Patent
Bloch

(10) Patent No.: US 10,493,641 B2
(45) Date of Patent: Dec. 3, 2019

(54) FOLDING KNIFE WITH REPLACEABLE BLADE

(71) Applicant: Outdoor Edge Cutlery Corporation, Denver, CO (US)

(72) Inventor: David R. Bloch, Morrison, CO (US)

(73) Assignee: OUTDOOR EDGE CUTLERY CORPORATION, Denver, CO (US)

( * ) Notice: Subject to any disclaimer, the term of this patent is extended or adjusted under 35 U.S.C. 154(b) by 190 days.

(21) Appl. No.: 15/165,830

(22) Filed: May 26, 2016

(65) Prior Publication Data

US 2016/0271809 A1 Sep. 22, 2016

Related U.S. Application Data

(63) Continuation-in-part of application No. 14/063,333, filed on Oct. 25, 2013, now Pat. No. 9,687,987.

(60) Provisional application No. 61/721,000, filed on Oct. 31, 2012.

(30) Foreign Application Priority Data

Oct. 26, 2012 (CN) ..... 2012 1 0418907

(51) Int. Cl.
*B26B 5/00* (2006.01)
*B26B 9/00* (2006.01)

(52) U.S. Cl.
CPC ..... *B26B 5/00* (2013.01); *B26B 9/00* (2013.01); *Y10T 29/4973* (2015.01)

(58) Field of Classification Search
CPC ..... B26B 5/00; B26B 9/00; Y10T 29/4973
See application file for complete search history.

(56) References Cited

U.S. PATENT DOCUMENTS

| | | | | |
|---|---|---|---|---|
| 1,738,365 | A | 12/1929 | Gahagan | |
| D100,877 | S | 8/1936 | Parker et al. | |
| D172,377 | S | 6/1954 | Woofter | |
| 3,488,843 | A * | 1/1970 | Tims, Jr. | B26B 5/00 30/162 |
| 3,772,955 | A | 11/1973 | Pearl | |
| 3,896,546 | A | 7/1975 | Hildebrandt | |
| 3,900,950 | A * | 8/1975 | Collins | B23D 51/10 30/331 |
| 4,161,818 | A | 7/1979 | Phelps | |

(Continued)

FOREIGN PATENT DOCUMENTS

| | | |
|---|---|---|
| CN | 1562585 | 1/2005 |
| CN | 2728796 | 9/2005 |

OTHER PUBLICATIONS

Notice of Allowance for U.S. Appl. No. 14/063,333, dated Mar. 2, 2017 9 pages.

(Continued)

*Primary Examiner* — Jonathan G Riley
(74) *Attorney, Agent, or Firm* — Lewis Brisbois Bisgaard & Smith LLP; Craig W. Mueller

(57) ABSTRACT

A knife is provided that includes a replaceable blade element. The knife employs a blade carrier that is fixedly interconnected to or foldable with respect to a handle. The blade carrier selectively receives the replaceable blade element that is locked into the blade carrier by way of a hook and movable pin combination. The replaceable blade element is designed to be inserted within the blade carrier quickly, easily, and safely.

22 Claims, 19 Drawing Sheets

(56) References Cited

U.S. PATENT DOCUMENTS 4,173,071 A 11/1979 Ishida
4,272,887 A * 6/1981 Poehlmann ..... B26B 1/046 30/161
4,274,200 A * 6/1981 Coder ..... B26B 1/046 30/161
D265,719 S 8/1982 Dowdy
4,404,748 A * 9/1983 Wiethoff ..... B26B 1/046 30/161
D277,452 S 2/1985 Ulvtorp
4,535,539 A * 8/1985 Friedman ..... B26B 1/046 30/159
5,272,812 A 12/1993 Doucette
5,442,855 A 8/1995 Jobin
5,511,310 A 4/1996 Sessions et al.
D371,288 S 7/1996 Thompson
D383,370 S 9/1997 Chen et al.
D385,471 S 10/1997 Seber et al.
5,689,889 A 11/1997 Overholt
D392,539 S 3/1998 Balolia
D393,405 S 4/1998 Seber et al.
5,930,902 A * 8/1999 Hsu ..... B23D 51/10 30/166.3
6,044,566 A 4/2000 Ries et al.
6,058,611 A * 5/2000 Rickard ..... B26B 9/02 30/329
D442,461 S 5/2001 Glesser
6,263,581 B1 * 7/2001 Forte ..... B26B 5/00 30/329
6,397,476 B1 6/2002 Onion
6,446,341 B1 9/2002 Wang et al.
6,574,868 B1 * 6/2003 Overholt ..... B26B 5/00 30/155
D501,782 S 2/2005 Ping
D510,250 S 10/2005 Ping
D516,403 S 3/2006 Ping
D517,893 S 3/2006 Ping
D519,019 S 4/2006 Ping
D522,835 S 6/2006 Ping
D526,878 S 8/2006 Ping
D528,894 S 9/2006 Ping
D528,895 S 9/2006 Ping
7,134,207 B2 11/2006 Ping
7,172,611 B2 2/2007 Harding et al.
D543,822 S 6/2007 Ping
D545,165 S 6/2007 Ping
D546,158 S 7/2007 Ping
D552,955 S 10/2007 Ping
D562,651 S 2/2008 Harkey
D564,326 S 3/2008 Tsuda et al.
D567,055 S 4/2008 Renzi et al.
D568,136 S 5/2008 Ping
D573,435 S 7/2008 Tsuda et al.
D574,691 S 8/2008 Ping
D578,858 S 10/2008 Ping
D579,299 S 10/2008 Ping
D583,643 S 12/2008 Ping
D584,125 S 1/2009 Ping
7,480,997 B2 1/2009 Ping
D592,033 S * 5/2009 Bloch ..... D22/118
D593,838 S 6/2009 Williams
7,900,363 B1 3/2011 White
D654,144 S 2/2012 Karlsson et al.
8,381,407 B1 2/2013 White
8,572,852 B1 * 11/2013 Jennings ..... B26B 5/001 30/162
8,935,855 B2 1/2015 Qiu
D728,339 S 5/2015 Bloch
D738,181 S 9/2015 Kanaan
D747,637 S 1/2016 Bloch
D751,882 S 3/2016 Bloch
D764,888 S 8/2016 Bloch
2004/0226173 A1 11/2004 Ping
2004/0231169 A1 * 11/2004 Roberson ..... B26B 1/044 30/321
2005/0138816 A1 6/2005 Ping
2005/0229404 A1 10/2005 Nordqvist et al.
2006/0064877 A1 3/2006 Vallotton et al.
2007/0006466 A1 1/2007 Ping
2007/0294895 A1 12/2007 Ping
2008/0148576 A1 6/2008 Ping
2008/0289191 A1 * 11/2008 LeBlanc ..... B26B 1/042 30/160
2009/0260234 A1 * 10/2009 Lai ..... B23D 51/01 30/161
2010/0175267 A1 * 7/2010 Seber ..... B26B 1/04 30/156
2010/0299935 A1 * 12/2010 Ping ..... B26B 1/042 30/161
2011/0023308 A1 2/2011 Ping
2012/0030949 A1 2/2012 Ping
2012/0227267 A1 9/2012 Qiu
2013/0227794 A1 9/2013 Wang
2013/0255087 A1 10/2013 Wang
2014/0115851 A1 5/2014 Bloch et al.
2014/0173912 A1 * 6/2014 Scimone ..... B26B 5/003 30/162
2014/0216605 A1 * 8/2014 Batty ..... B27G 15/00 142/56
2016/0067803 A1 * 3/2016 Kohl ..... B26B 1/044 30/161
2016/0271809 A1 * 9/2016 Bloch ..... B26B 5/00

OTHER PUBLICATIONS

Notice of Allowance for U.S. Appl. No. 29/551,898, dated Apr. 11, 2017 8 pages.
U.S. Appl. No. 29/551,796, filed Jan. 15, 2016, Bloch.
U.S. Appl. No. 29/551,898, filed Jan. 18, 2016, Bloch.
U.S. Appl. No. 29/570,656, filed Jul. 11, 2016, Bloch et al.
Official Action for Canadian Patent Application No. 2,889,292, dated Mar. 1, 2016, 6 pages.
Extended European Search Report for European Patent Application No. 13848616.2, dated Jun. 14, 2016, 5 pages.
Official Action for U.S. Appl. No. 14/063,333, dated Sep. 11, 2015 6 pages Restriction Requirement.
Official Action for U.S. Appl. No. 14/063,333, dated Nov. 9, 2015 16 pages.
Final Action for U.S. Appl. No. 14/063,333, dated May 20, 2016 16 pages.
Official Action for U.S. Appl. No. 14/063,333, dated Aug. 25, 2016 21 pages.
Notice of Allowance for U.S. Appl. No. 29/515,058, dated May 11, 2016, 8 pages.
U.S. Appl. No. 29/566,349, filed May 27, 2016, Bloch.
U.S. Appl. No. 29/575,909, filed Aug. 30, 2016, Bloch.
Notice of Allowance for Canadian Patent Application No. 2,889,292, dated Nov. 29, 2016, 1 page.
Official Action for European Patent Application No. 13848616.2 dated Dec. 2, 2016, 3 pages.

* cited by examiner (ROTATED 90 DEGREES CLOCKWISE)

(ROTATED 180 DEGREES CLOCKWISE)

FOLDING KNIFE WITH REPLACEABLE BLADE

This application is a continuation-in-part of U.S. patent application Ser. No. 14/063,333, "Folding Knife with Replaceable Blade," filed Oct. 25, 2013, which claims the benefit of U.S. Provisional Patent Application Ser. No. 61/721,000, "Folding Knife with Replaceable Blade," filed Oct. 31, 2012, and Chinese Patent CN201210418907.0, entitled Cutting Tool with Replaceable Blade," filed Oct. 26, 2012, the entire disclosures of which are incorporated by reference herein.

This application is also related to U.S. Pat. No. D592,033, which discloses a locking version of the knife described in U.S. Patent Application Publication No. 2005/0229404 and European Patent No. EP1570959, the entirety of each of these references being incorporated by reference herein.

FIELD OF THE INVENTION

Embodiments of the present invention generally relate to knives. More specifically, one embodiment of the present invention is a folding knife that has a replaceable blade element. Another embodiment is a non-folding knife with a replaceable blade element.

BACKGROUND OF THE INVENTION

Knives are usually comprised of a handle with a blade that is interconnected thereto. Some knives employ blades that are rotatably interconnected, and selectively lockable, to the handle. When the knife is not in use, it is sheathed or, in the case of folding knives, the blade is folded into the handle. When in use, the rotatable blade is extended from the handle and locked in place. Such locking mechanisms are known and engage a portion of the blade to hold it in place until the user disengages the lock mechanism, which allows the blade to be folded into an opening in the handle to conceal all or a portion of the blade.

Regardless of knife type, it is desirable to provide a cutting edge that is very sharp, similar to the sharpness provided by a razor blade. However, razor blade sharpness comes at a price. More specifically, razor blades often possess very thin edges that are brittle and wear, i.e., lose their edge, relatively quickly. Blade performance can be repaired by sharpening, but doing so will reduce blade size and durability. In addition, thin razor blades lack lateral strength and are thus flimsy and can fracture easily when put to hard use to cut forcibly or when cutting at an angle that applies lateral side-force to the blade. Thus, some knives employ a razor-sharp replaceable blade element that fits within a blade carrier, which may be foldable within a handle. Once the replaceable blade element becomes dull, or after repeated sharpening, it is removed from the blade carrier and discarded. Another razor blade is then inserted into the carrier.

Some knives of this type employ a complicated blade interconnection mechanism. For example, U.S. Pat. Nos. 5,689,889 and 6,574,868 to Overholt disclose razor blades for interconnecting to a blade carrier of folding knife. These knives receive the replacement blade member in a complicated fashion wherein the replaceable blade element must be first introduced into the blade carrier at and angle and then rotated into place. Finally, the replaceable blade element is locked within the blade carrier. As one of skill in the art will appreciate, replacing a blade in this fashion is difficult and, because the replaceable blade members are extremely sharp, manipulating the blade into place can cause injury. To lock and secure the blade, Overholt discloses the use of a separate threaded fastener that attaches to the blade carrier. To replace the blade, the fastener must first be loosened and completely detached from the blade carrier before the sharpened razor blade portion can be removed. This is time consuming and dangerous because the user must remove the fastener by hand from the blade carrier, which is located in close proximity to the sharp cutting edge of the razor blade. Further, loosening or removing the fastener requires the use of both hands, which makes it not possible to safely hold the knife or secure the knife by the handle while removing the fastener. Further, the fastener is commonly made up of two or more small parts that must be detached from the blade carrier to replace the blade. The fastener parts can easily be dropped and lost, especially when used in the outdoors. If one or more small parts of the fastener are lost when changing the blade, the new blade cannot be attached to the blade carrier and the knife is no longer functional.

The following disclosure describes a knife with the replaceable blade that is selectively inserted into blade carrier in a way that facilitates easy interconnection, reduces the chance of injury, and eliminates the need for separate parts that must be detached from the knife to remove and insert a new blade.

SUMMARY OF THE INVENTION

It is one aspect of embodiments of the present invention to provide a folding knife with a replaceable blade. More specifically, one embodiment of the present invention includes a handle having a first portion and a second portion spaced from the first portion. The space between the first handle portion and the second handle portion receives the replaceable blade when the knife is not in use. A blade carrier is rotatably interconnected to the handle and operates as in a traditional folding knife: 1) in a first position of use wherein at least a portion of the blade carrier is positioned within the housing; and 2) in a second position of use wherein the blade carrier is locked in an open position and extended from the housing. The blade carrier selectively receives a replaceable blade element.

It is another aspect of embodiments of the present invention to provide a non-folding knife with the replaceable blade portion. More specifically, one embodiment of the present invention includes a handle with a fixed blade carrier.

The blade carrier of embodiments of the present invention have a first carrier portion and a second carrier portion, which is spaced from the first carrier portion, which receives the replaceable blade. The first carrier also includes a channel that selectively receives a pin. The second blade carrier includes a flexible member with a pin that selectively engages an aperture in the replaceable blade member to secure it to the blade carrier.

To replace the blade, a release button, which is spring-biased relative to the handle, is depressed which deflects portion of the second blade carrier. Deflection of the blade carrier removes the pin from the aperture, which allows the blade to be removed. The blade is inserted in a direction generally parallel to the longitudinal axis of the handle, i.e., in a direction parallel to the length of the handle. Thus complicated blade rotation is not necessary to secure the blade to the blade carrier.

It is another aspect of embodiments of the present invention to provide a knife that includes a replaceable blade that is safe and easy to remove. More specifically, as mentioned above, replaceable blades of the prior art are in many respects difficult to engage into the blade carrier and require a complicated interconnection sequence requiring the use of both hands to remove the locking/retaining portion of the blade from the blade carrier. The contemplated replaceable blade portion is inserted longitudinally relative to the handle. Also, the blade is designed to extend from the carrier so that is easy to grasp with the thumb and forefinger of one hand while the other hand securely grasps the handle portion and depresses the lock release button with one finger. This makes it much easier, faster, and safer to attach and remove the replaceable blade.

It is another aspect of embodiments of the present invention to provide a knife that eliminates the need for small separate parts (other than the replacement blades) that must be detached from the knife to change the blade. The prior art teaches a blade fastener that requires small parts that must be detached and can easily be lost when replacing the blade. With embodiments of the present invention, there are no separate parts required to fasten and detach the replaceable blade from the knife.

It is another aspect of embodiments of the invention to provide a knife, comprising: a blade carrier having a first portion that is spaced from a second portion, the blade carrier being connected to a handle; a first blade liner portion associated with the first blade carrier; a second blade liner portion associated with the second portion of the blade carrier; a replaceable blade positioned between the first blade carrier and the second portion of the blade carrier; a replaceable blade release button associated with a deflectable portion of the first blade liner portion; a guard surrounding at least a portion of the replaceable blade release button; and a pin interconnected to the second portion of the blade carrier that is deflected to release the replaceable blade when the release button is depressed.

It is yet another aspect of embodiments of the present invention to provide a cutting tool having a blade carrier that is connected to a handle and selectively lockable relative thereto, a blade liner associated with the carrier, and a replaceable blade selectively interconnected to the blade carrier, the improvement comprising: a release button associated with a deflectable portion of the blade liner portion; a guard surrounding at least a portion of the release button; a pin interconnected to the blade carrier and adapted to be received within an aperture of the replaceable blade that is deflected by the release button to release the replaceable blade; and wherein the replaceable blade includes a hook on an upper edge thereof that selectively engages a member integrated within the blade carrier, and wherein the replaceable blade is positioned within the blade carrier along a longitudinal axis of the blade carrier.

It is still yet another aspect of embodiments of the present invention to provide a method of replacing a replaceable blade into a knife comprising a blade carrier having a first portion that is spaced from a second portion, the blade carrier being connected to a handle; a first blade liner portion associated with the first blade carrier; a second blade liner portion associated with the second portion of the blade carrier; a replaceable blade positioned between the first blade carrier and the second portion of the blade carrier; a replaceable blade release button associated with a biasing member of the first blade liner portion; a guard surrounding at least a portion of the replaceable blade release button; and a pin interconnected to the second portion of the blade carrier, comprising: depressing the release button; engaging an end of the release button onto the second portion of the blade carrier; deflecting a portion of the second portion of the blade carrier; removing the pin away from an aperture of the replaceable blade; and moving the replaceable blade from the blade carrier.

It is still yet another aspect of embodiments of the present invention to provide a guard having a surface texture that is different than a surface texture of a portion of the handle surrounding the guard.

It is still yet another aspect of embodiments of the present invention to provide a guard having a surface texture that is different than a surface texture of the replaceable blade release button.

It is still yet another aspect of embodiments of the present invention to provide a guard that comprises a raised ridge, at least a portion of which extends from the handle by approximately the same distance as the replaceable blade release button.

It is still yet another aspect of embodiments of the present invention to provide a guard that is attached to the handle by an adhesive or a fastener.

It is still yet another aspect of embodiments of the present invention to provide a guard that is formed of the same material as the handle.

It is still yet another aspect of embodiments of the present invention to provide a guard that comprises portions extending from the handle by a greater distance than other portions.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
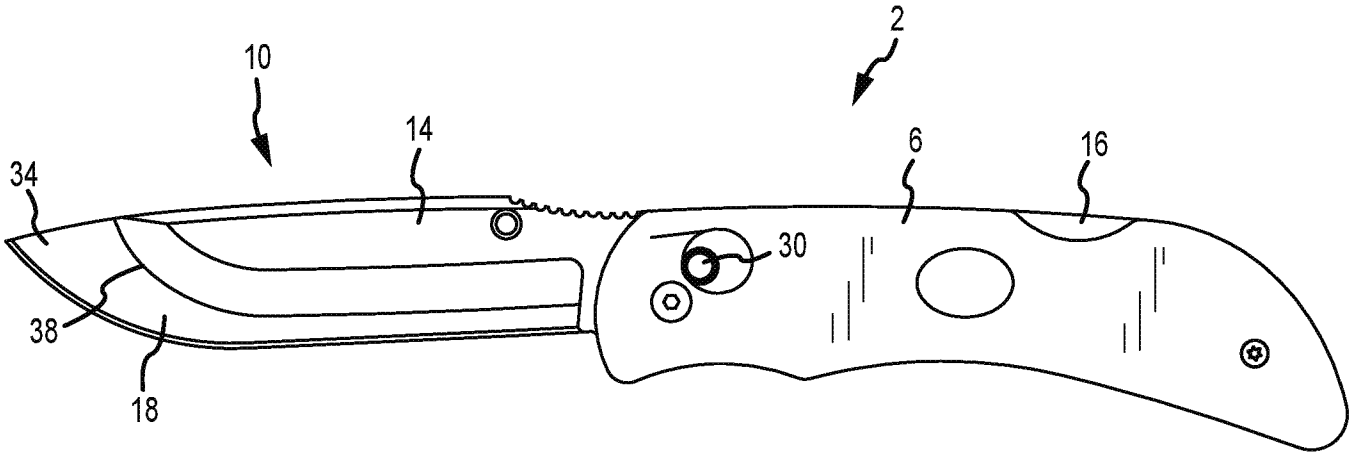
FIG. 1 is a front elevation view of a folding knife with a replaceable blade of one embodiment of the present invention.

To assist in the understanding of one embodiment of the present invention the following list of components and associated numbering found in the drawings is provided herein:

| # | Component |
|---|---|
| 2 | Knife |
| 6 | Handle |
| 10 | Blade |
| 14 | Blade carrier |
| 15 | Member |
| 16 | Blade carrier lock release |
| 17 | Guide surface |
| 18 | Replaceable blade |
| 22 | Blade carrier lock |
| 26 | Upper portion |
| 30 | Replaceable blade lock release button |
| 34 | Front blade portion |
| 38 | Front edge |
| 46 | Replaceable blade lock protrusion |
| 50 | Hook |
| 54 | Blade carrier liner |
| 58 | Lock release button pin end |
| 62 | Channel |
| 66 | Biasing member |
| 68 | Recess |
| 70 | Tab |
| 72 | Recess |
| 74 | Aperture |
| 78 | Sloped surface |
| 82 | Blade end |
| 102 | Knife |
| 106 | Handle |
| 110 | Blade |
| 114 | Blade carrier |
| 115 | Member |
| 118 | Replaceable blade |
| 130 | Replaceable blade lock release button |
| 134 | Front blade portion |
| 138 | Front edge |
| 146 | Replaceable blade lock protrusion |

-continued

| # | Component |
|---|---|
| 150 | Hook |
| 154 | Blade carrier support |
| 158 | Lock release button pin end |
| 162 | Opening |
| 166 | Biasing member |
| 168 | Recess |
| 169 | Spring plate |
| 170 | Tab |
| 172 | Recess |
| 174 | Aperture |
| 178 | Sloped surface |
| 182 | Blade end |
| 184 | Sloped surface |
| 202 | Knife |
| 206 | Handle |
| 210 | Blade |
| 214 | Blade carrier |
| 216 | Blade carrier lock release |
| 218 | Replaceable blade |
| 230 | Replaceable blade lock release button |
| 234 | Guard |
| 250 | Second end |
| 254 | Contact surface |
| 258 | Perimeter wall |
| 262 | Wall |
| 266 | Contact surface |
| 270 | Outer edge |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 1-9 show a knife 2 of one embodiment of the present invention that includes a handle 6 that is operably interconnected to a blade 10. The blade 10 is comprised of a blade carrier 14 that selectively receives a replaceable blade 18. The blade carrier 14 is locked in place by a common locking mechanism 22 (see, FIGS. 8 and 9). In one embodiment of the present invention a lock 22 selectively engages an upper portion 26 of the blade carrier 14 wherein a release button 16 is used to move the lock 22 in a lateral direction which unseats the lock 22 from the blade carrier 14.

Figure 2:
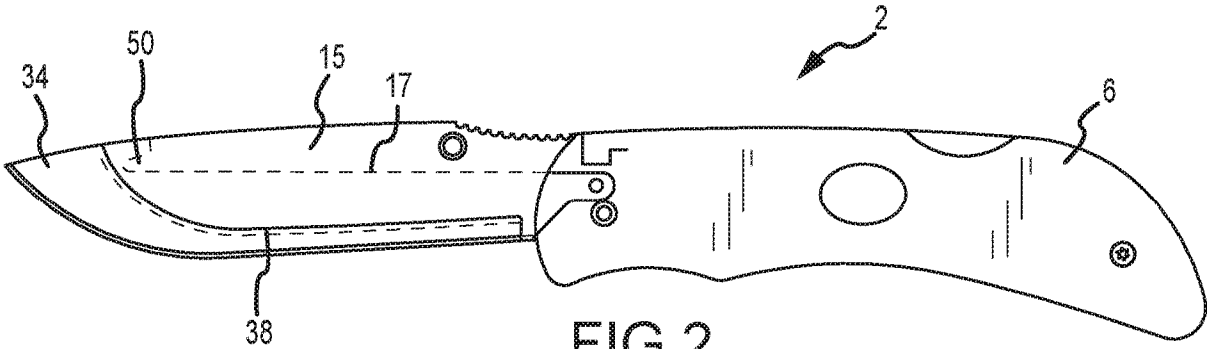
FIG. 2 is a front elevation view of FIG. 1.
Figure 3:
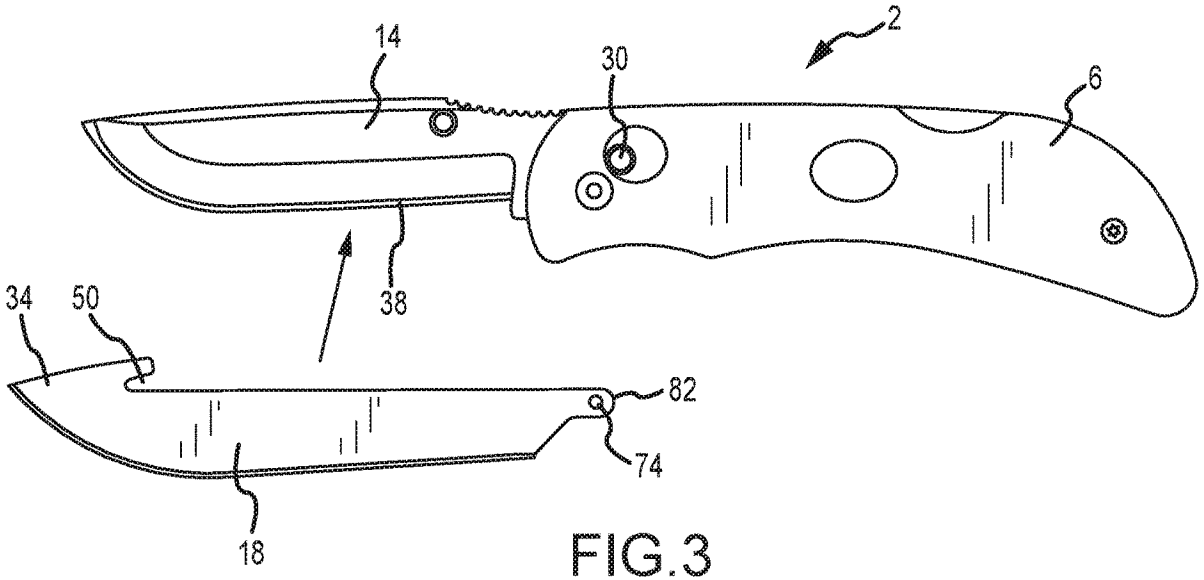
FIG. 3 is a front elevation view of FIG. 1 wherein the replaceable blade has been removed.
Figure 4:
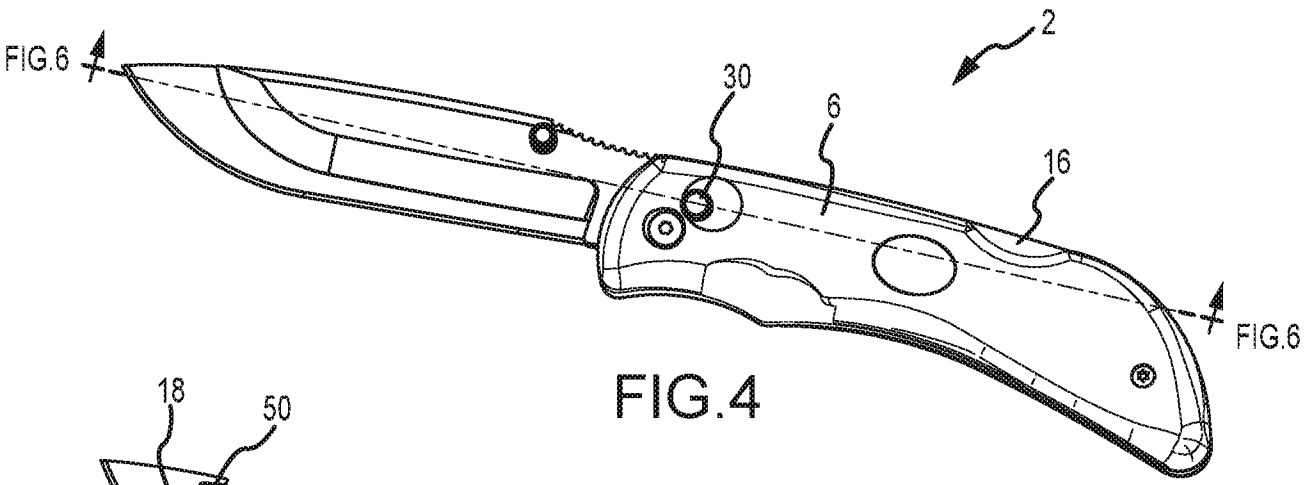
FIG. 4 is a perspective view of FIG. 1.
Figure 5:
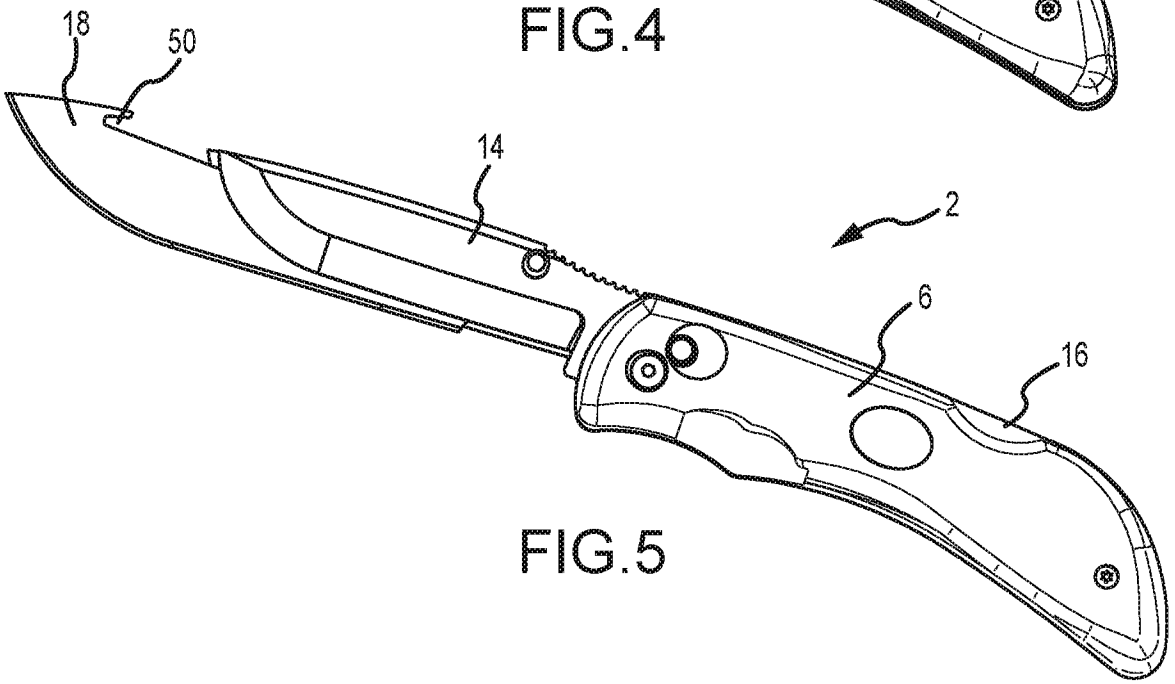
FIG. 5 is a perspective view of FIG. 1, wherein the blade is partially inserted in the carrier portion of the knife but not locked in a position of use.

FIGS. 2 and 3 show the replaceable blade 18 captured by the blade carrier 14 and removed therefrom, respectively. A front blade portion 34 of the replaceable blade 18 extends from a front edge 38 of the blade carrier 14, which facilitates grasping of the replaceable blade 18. That is, the replaceable blade 18 also extends from the front edge 38 of the blade carrier 14, which provides ample room for the user to grasp the replaceable blade 18 with their thumb and forefinger. In addition, the majority of the length of the replaceable blade 18 is supported by the carrier 14, which provides enhanced stiffness and support. More specifically, the blade carrier in some instances will support the replaceable blade 18 such that it can be sharpened. To release the replaceable blade 18, which will be discussed in further detail below, the user engages a replaceable blade lock release button 30. The replaceable blade 18 is secured to the carrier 14 on one end by a lock pin 46 and on the other end by a member 15 positioned between the first blade carrier 14' and the second blade carrier 14" that receives a hook 50 on the replaceable blade 18. The member 15 also includes a guide surface 17 that facilitates interconnection of the replaceable blade 18 and the carrier 14.

FIG. 3 shows that in one embodiment of the present invention the first blade carrier portion 14' and the second blade carrier portion 14" have different widths and/or lengths. More specifically, the first blade carrier portion 14' may have a width/length that is less than the width/length of the second blade carrier portion 14". In operation, the replaceable blade 18 is abutted against a portion of the second blade carrier portion 14" that extends beyond the width or length of the first blade carrier portion 14'. The offset surface between the blade carrier portion forms a ledge that acts as a guide that facilitates interconnection of the replaceable blade 18 into the carrier 14. Without this offset surface, the replaceable blade 18 must be aligned and inserted directly into the small gap between the first blade carrier 14' and the second blade carrier 14", thus requiring greater skill and dexterity to facilitate the interconnection of the replaceable blade 18 into the carrier 14. In addition, to facilitate interconnection, an end of the replaceable blade 82 is abutted against the guide surface 17 and slid rewardly until the hook 50 is engaged onto a corresponding portion of the member 15. In this fashion, a user must only grasp the front blade portion 34 of the replaceable blade 18 and safety is enhanced.

Figure 6:
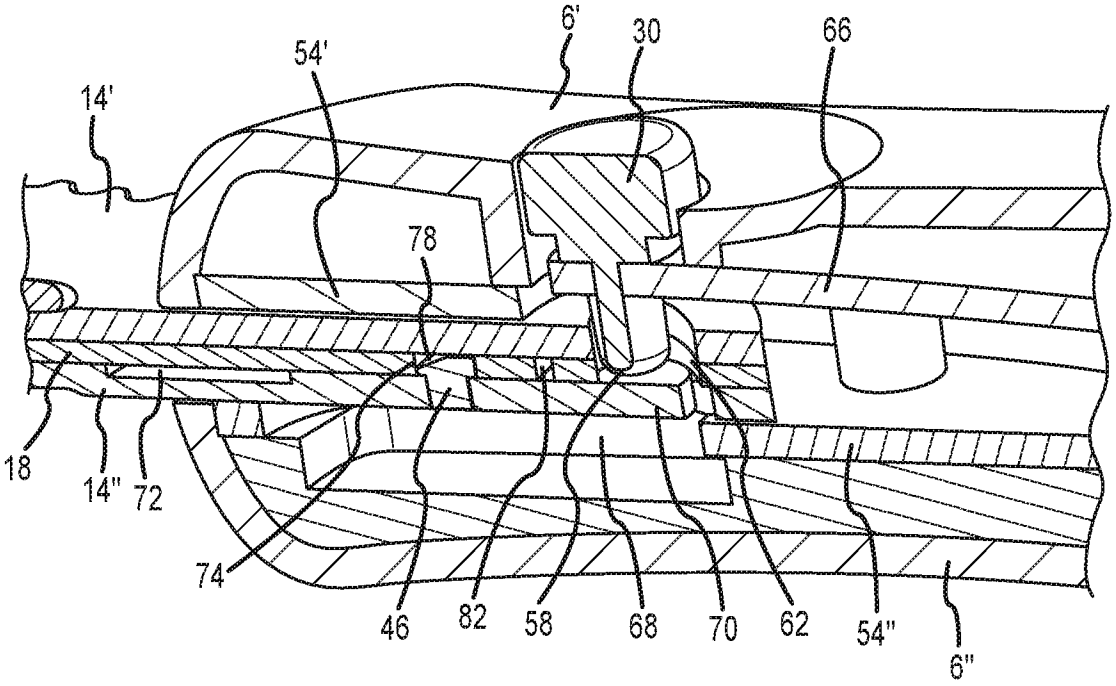
FIG. 6 is a partial cross-section of FIG. 1.

FIG. 6 is a cross-sectional view of one embodiment of the present invention. The handle is composed of a first handle portion 6' and a second handle portion 6" that are spaced to provide a gap for receipt of a first blade carrier portion 14' and the second blade carrier portion 14". A first blade carrier liner 54' is associated with the first handle portion 6' and a second blade carrier liner 54" is associated with the second handle portion 6". The first blade carrier liner 54' and the second blade carrier liner 54" are associated with corresponding blade carrier portions and provide support thereto. The blade lock release button 30 is associated with the first blade carrier liner 54' and has an end 58 that selectively engages a flexible portion of the second blade carrier 14". The first blade carrier 14' also has an arcuate channel 62 (FIG. 8) that receives a portion of the blade lock release button 30.

Figure 7:
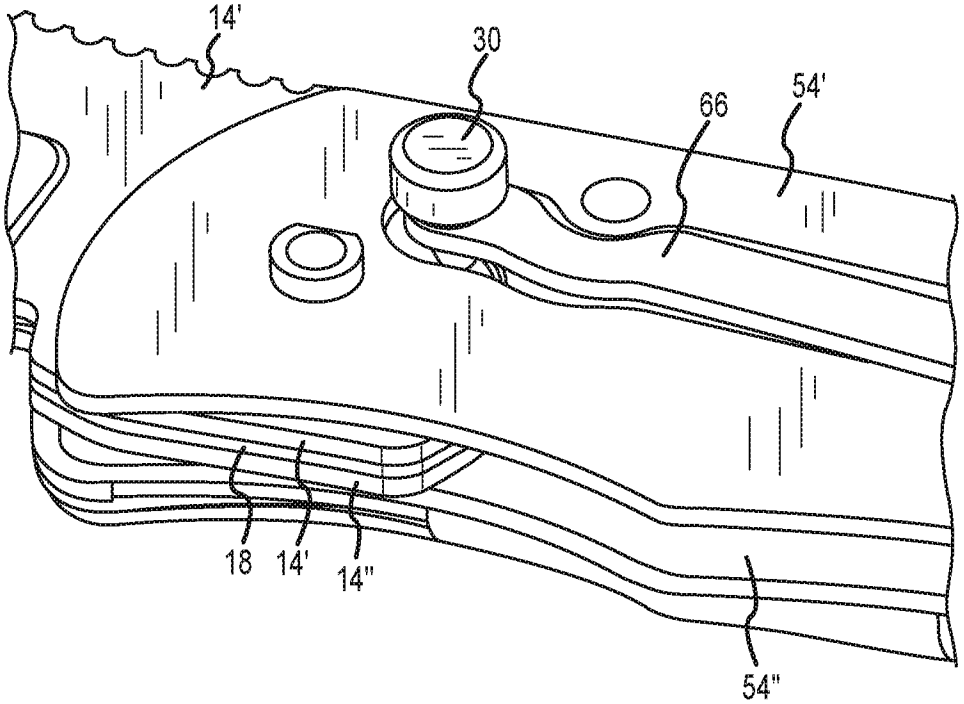
FIG. 7 is a detailed front perspective view wherein a first handle portion has been removed for clarity.
Figure 8:
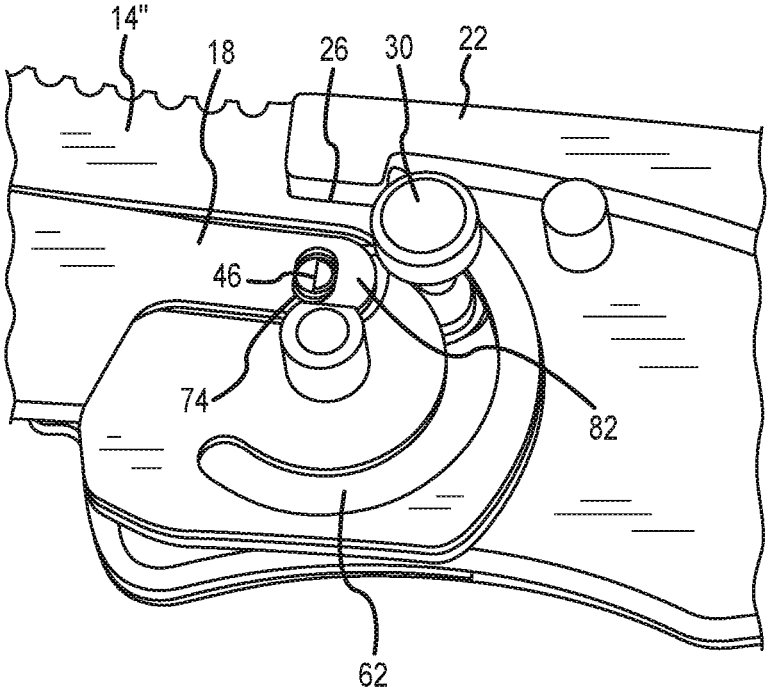
FIG. 8 is another detailed front perspective view wherein a first handle portion has been removed for clarity.
Figure 9:
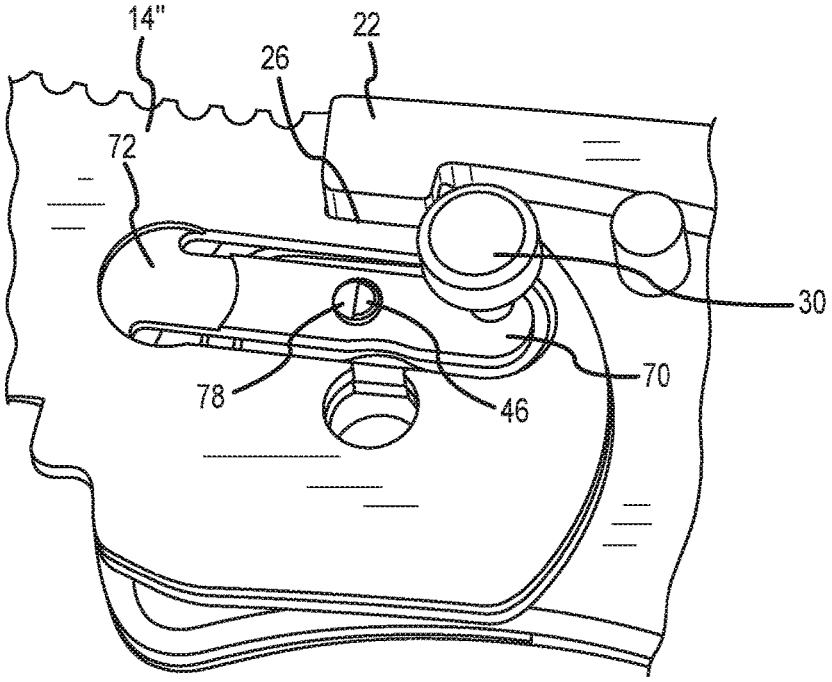
FIG. 9 is yet another detailed from perspective view wherein a first handle portion has been removed for clarity.
Figure 10:
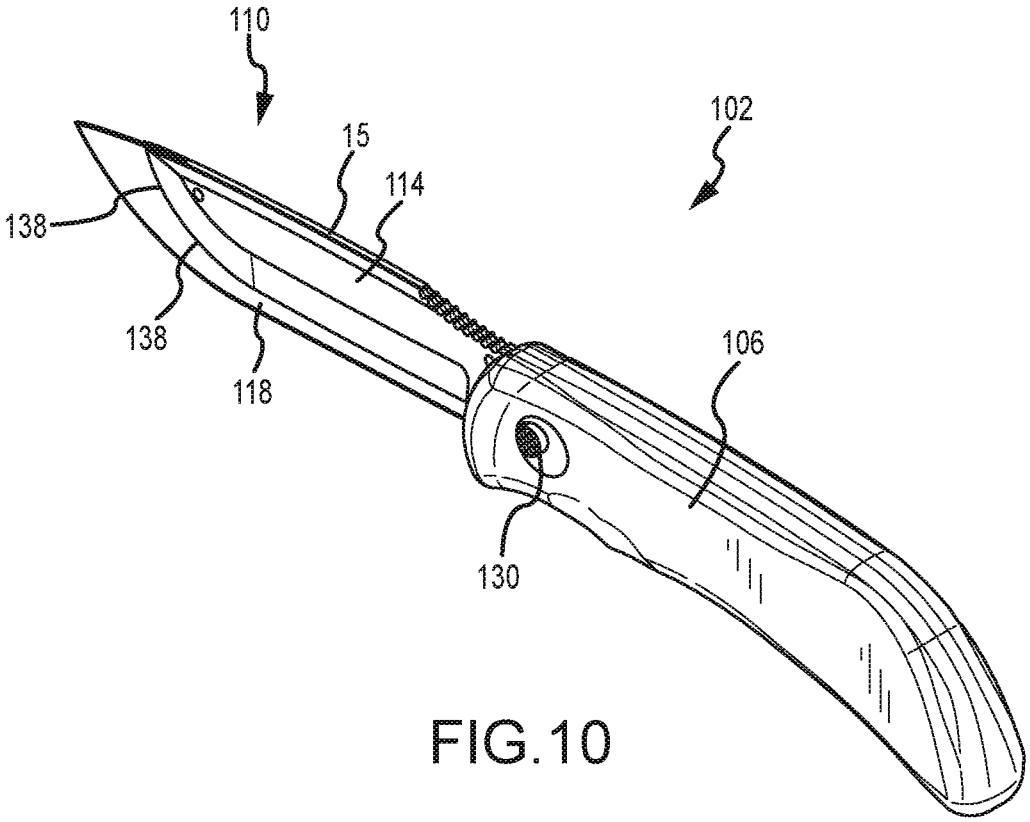
FIG. 10 is a perspective view of another embodiment of the present invention wherein the removable blade element is used in conjunction with a fixed blade.

FIG. 7 shows the first blade carrier liner 54' in greater detail. The first blade carrier liner 54' has a biasing member 66, i.e., an outwardly extending portion thereof that biases the blade release button 30 in a locked position. Depression of the blade release button 30 flexes the biasing member 66 inwardly which forces a portion of the second carrier 14" into a recess 68 (FIG. 6) of the second blade carrier liner 54" which removes the lock pin 46 from the replaceable blade 18. One of skill in the art will appreciate that the biasing member may be a deflectable portion of the carrier liner 54', a leaf spring, a coil spring associated with the blade lock release button 30, or any other spring device known in the art.

More specifically, the blade lock release button 30, when depressed, selectively engages a flexible tab 70 of the second blade carrier. The tab also includes the lock pin 46. Depression of the release button 30 deflects the tab 70 and moves the lock pin 46 in a lateral direction which moves the lock pin 46 out of an aperture 74 of the blade 18. The flexible tab 70 may further include a recess 72, indent, or scalloped portion that facilitates deflection. When the obstruction created by the lock pin 46 is removed, the blade 18 can be removed from the blade carriers 14. The lock pin 46 may have a sloped surface 78 that when contacted by an inserting blade deflects the tab 70 so that the blade can be fully inserted. More specifically, sliding the blade 18 in a direction parallel to the longitudinal axis of the knife 2 will engage the rear surface 82 of the blade 18 against the sloped surface 78 of the pin, which will deflect the tab 70. The blade end 82 may employ a corresponding sloped surface (see, FIG. 15, reference no. 184) that interacts with the sloped surface 78 of the pin, which facilitates insertion of the replaceable blade. Once the end portion 82 of the blade 18 is positioned past the lock pin 46, the aperture 74 will eventually be positioned over the lock pin 46 and the pin will recoil to secure the blade.

FIGS. 10-20 show a knife 102 of one embodiment of the present invention that includes a handle 106 that is fixedly interconnected to a blade 110. The blade 110 is comprised of a blade carrier 114 that selectively receives a replaceable blade 118.

Figure 11:
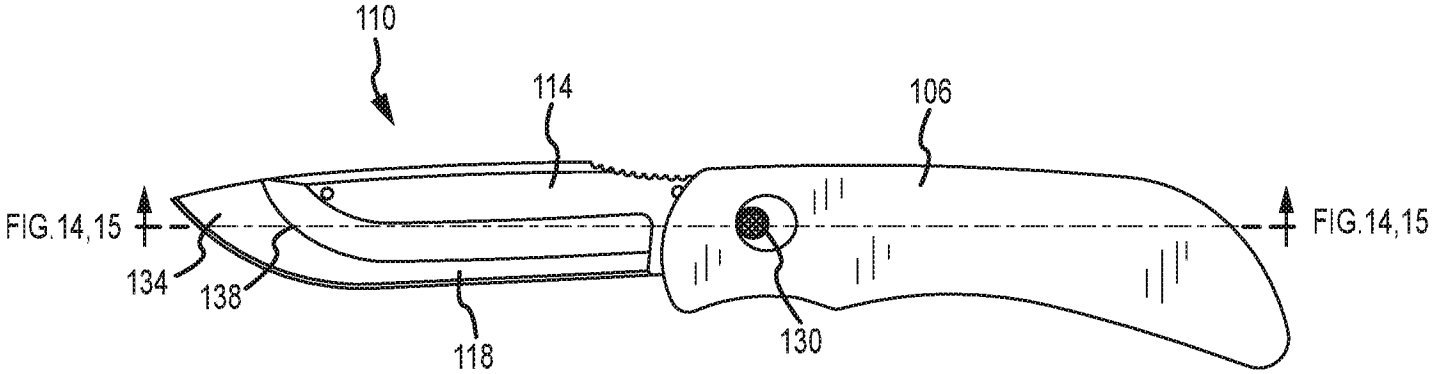
FIG. 11 is a front elevation view of FIG. 10.
Figure 12:
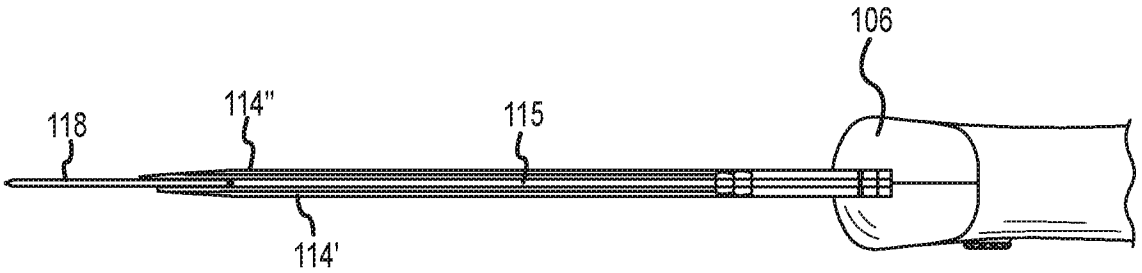
FIG. 12 is a top plan view of FIG. 10.
Figure 13:
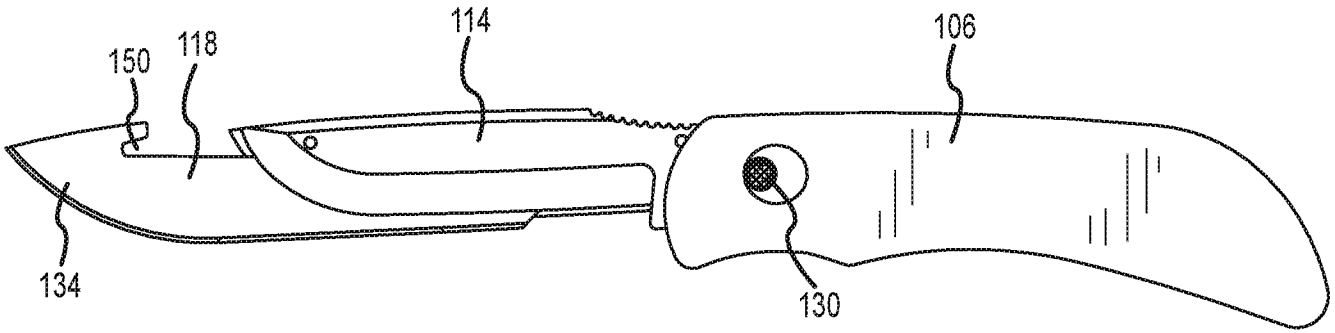
FIG. 13 is a front elevation view of FIG. 10 showing the removable blade element partially inserted in the carrier portion of the knife but not locked in a position of use.

FIGS. 11-13 show the replaceable blade 118 captured by the blade carrier 114 and removed therefrom, respectively. A front blade portion 134 of the replaceable blade 118 extends from a front edge 138 of the blade carrier 14, which facilitates grasping of the replaceable blade 118. That is, the replaceable blade 118 also extends from the front edge 138 of the blade carrier 114, which provides ample room for the user to grasp the replaceable blade 118 with their thumb and forefinger. In addition, the majority of the length of the replaceable blade 118 is supported by the blade carrier 114, which provides enhanced support. To release the replaceable blade 118, which will be discussed in further detail below, the user engages a replaceable blade lock release button 130. As described above with respect to FIGS. 2 and 3, the replaceable blade 118 is secured to the carrier 114 on one end by a lock pin 146 (FIG. 15) and on the other end by a member 115 positioned between the first blade carrier 114' and the second blade carrier 114" that receives a hook 150 on the replaceable blade 118. The member 115 also includes a guide surface similar to that described above that facilitates interconnection of the replaceable blade 118 and the carrier 114.

Similar to the embodiment shown in FIG. 3, this embodiment of the present invention may also have a first blade carrier portion 114' and the second blade carrier portion 114" have different widths and/or lengths. More specifically, the first blade carrier portion 114' may have a width/length that is less than the width/length of the second blade carrier portion 114". In operation, the replaceable blade 118 is abutted against a portion of the second blade carrier portion 114" that extends beyond the width and/or length of the first blade carrier portion 114'. The offset surface between the blade carrier portion forms a ledge that acts as a guide that facilitates interconnection of the replaceable blade 118 into the carrier 114. Without this offset surface, the replaceable blade 118 must be aligned and inserted directly into the small gap between the first blade carrier 114' and the second blade carrier 114", thus requiring greater skill and dexterity to facilitate the interconnection of the replaceable blade 118 into the carrier 114. In addition, to facilitate interconnection, an end of the replaceable blade 182 (FIG. 15) is abutted against the guide surface (not show, but similar to the guide surface 17 described above) and slid rewardly until the hook 150 is engaged onto a corresponding portion of the member 115 (FIG. 12). In this fashion, a user must only grasp the front blade portion 134 of the replaceable blade 18 and safety is enhanced.

Figure 14:
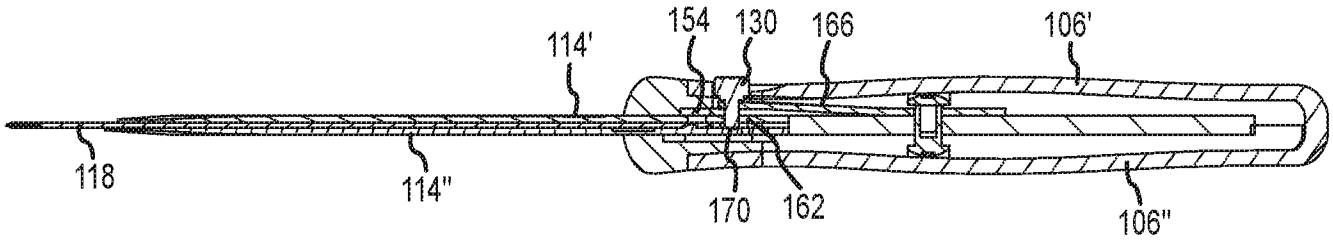
FIG. 14 is a cross-sectional view of FIG. 11.
Figure 15:
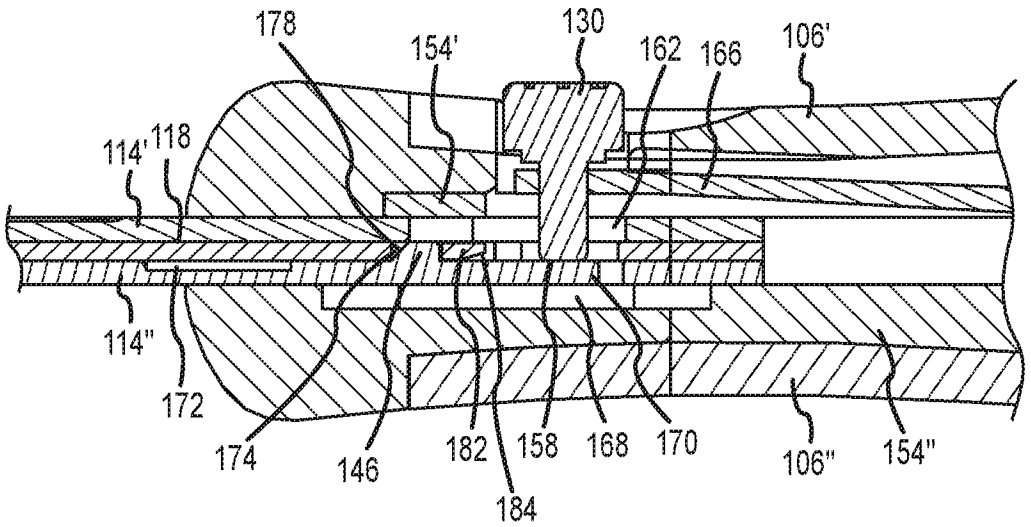
FIG. 15 is a detailed view of FIG. 14.

FIGS. 14 and 15 are cross-sectional views of a fixed blade embodiment of the present invention. The handle 106 is composed of a first handle portion 106' and a second handle portion 106". A first blade carrier support 154' is associated with the first handle portion 106' and a second blade carrier support 154" is associated with the second handle portion 106". The blade lock release button 130 is associated with the first blade carrier support 154' and has an end 158 that selectively engages a flexible portion of the second blade carrier 114".

FIG. 15 shows the first blade carrier support 154' in greater detail. The first blade carrier support 154' has a biasing member 166, i.e., an outwardly extending portion thereof that biases the blade release button 130, which is secured thereto. Depression of the blade release button 130 flexes the biasing member 166 inwardly which forces a portion of the second carrier 114" into a recess 168 which removes the lock pin 146 from the blade 118. One of skill in the art will appreciate that the biasing member may be a deflectable portion of the carrier support 54', a leaf spring, a coil spring associated with the blade lock release button 30, or any other spring device known in the art.

Figure 16:
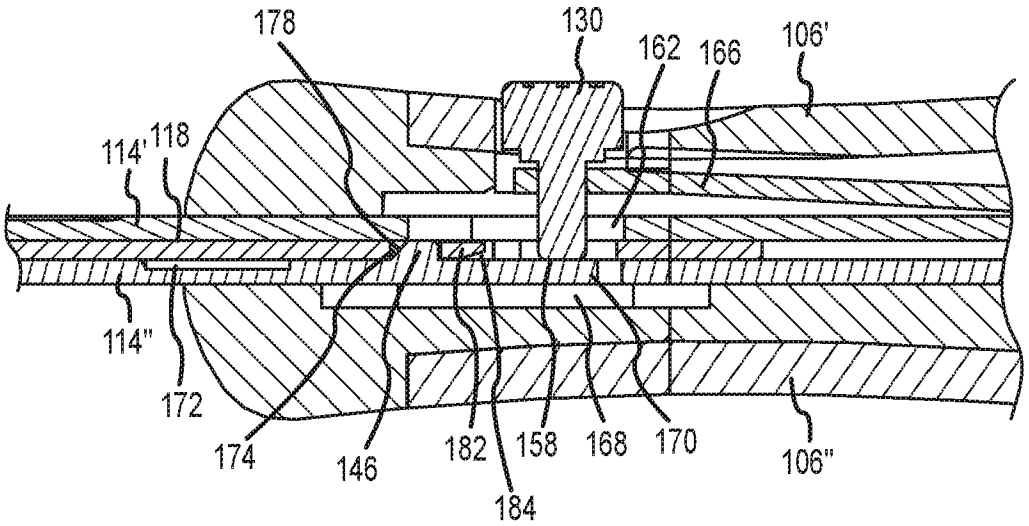
FIG. 16 is a detailed view of FIG. 14, showing an alternate embodiment.
Figure 17:
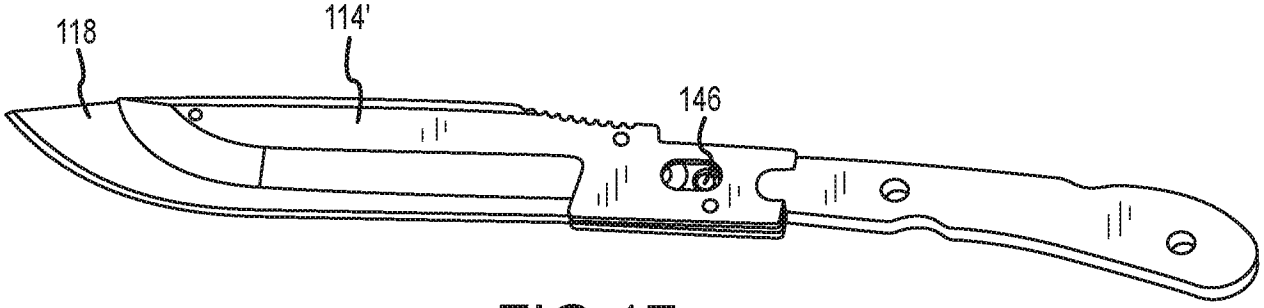
FIG. 17 is a perspective view showing a fixed blade version of the knife without the handle.
Figure 18:
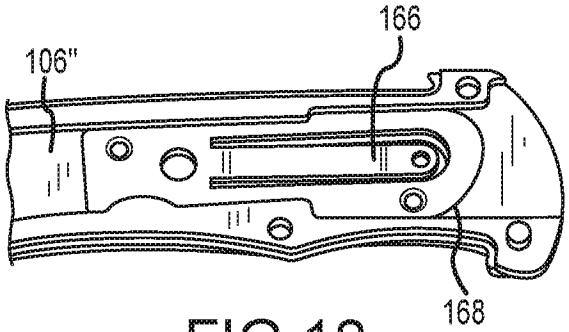
FIG. 18 is a detailed view of FIG. 17.
Figure 19:
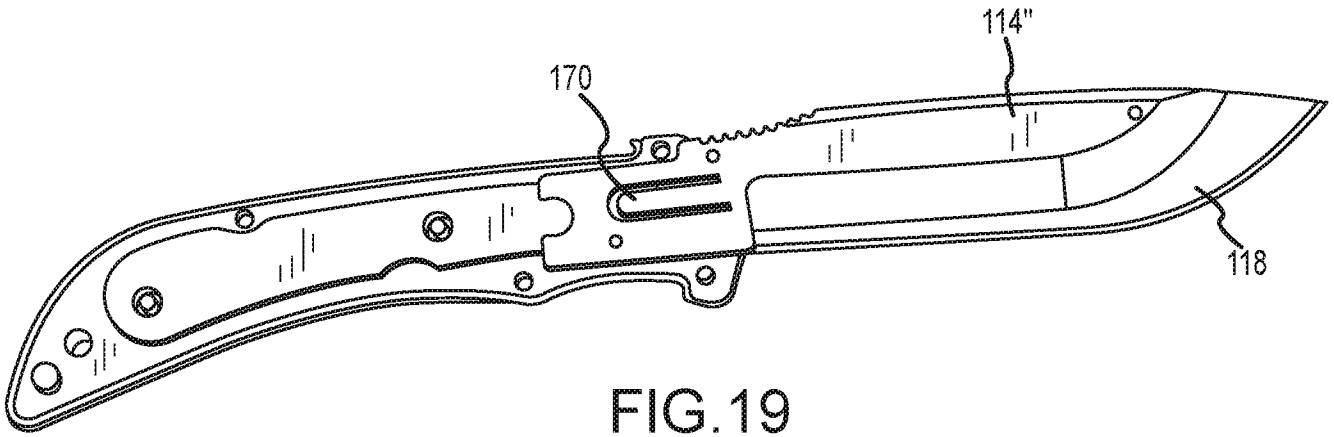
FIG. 19 is a perspective view is a rear perspective view of a fixed blade version if the knife wherein half the handle is omitted for clarity.
Figure 20:
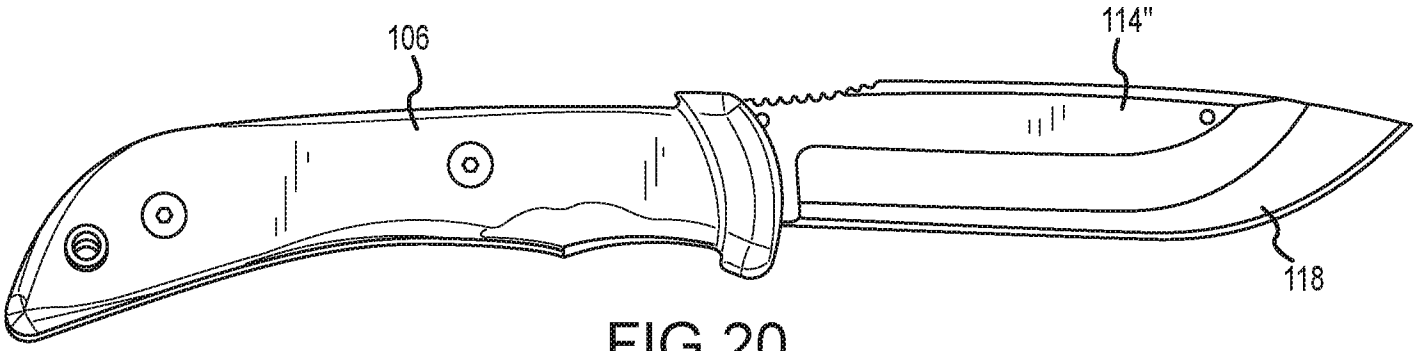
FIG. 20 is a perspective view of the fixed blade version of the knife.

FIG. 16 shows the first blade carrier 114' in greater detail. In this embodiment the first blade carrier 114' and the second blade carrier 114" extend towards the midpoint of the handle 106. Further, the biasing member 166 is integral with the first blade carrier 114'. In addition, liners described above are not needed. Depression of the blade release button 130 flexes the biasing member 166 inwardly which forces a portion of the second carrier 114" into a recess 168 which removes the lock pin 146 from the blade 118. One of skill in the art will appreciate that the biasing member may be a leaf spring, a coil spring associated with the blade lock release button 30, or any other spring device known in the art.

More specifically, the blade lock release button 130, when depressed, selectively engages a flexible tab 170 of the second blade carrier 114". The tab 170 also includes the lock pin 146. The flexible tab 170 may further include a recess 172, indent, or scalloped portion that facilitates deflection. Depression of the release button 130 deflects the tab 170 and moves the lock pin 146 in a lateral direction which moves the lock pin 146 out of an aperture 174 of the blade 118. When the obstruction created by the lock pin 146 is removed, the blade 118 can be removed from the blade carriers 114. The lock pin 146 may have a sloped surface 178 that when contacted by an inserting blade deflects the tab 170 so that the blade can be fully inserted. The blade end 182 may employ a corresponding sloped surface 184 that interacts with the sloped surface 178 of the pin, which facilitates insertion of the replaceable blade. More specifically, sliding the blade 118 in a direction parallel to the longitudinal axis of the knife 102 will engage the rear surface of the blade 118 against the sloped surface 78 of the pin, which will deflect the tab 170. Once the end portion 182 of the blade 118 is positioned past the lock pin 146, the aperture 174 will eventually be positioned over the lock pin 146 and the pin will recoil to secure the blade.

Figure 21:
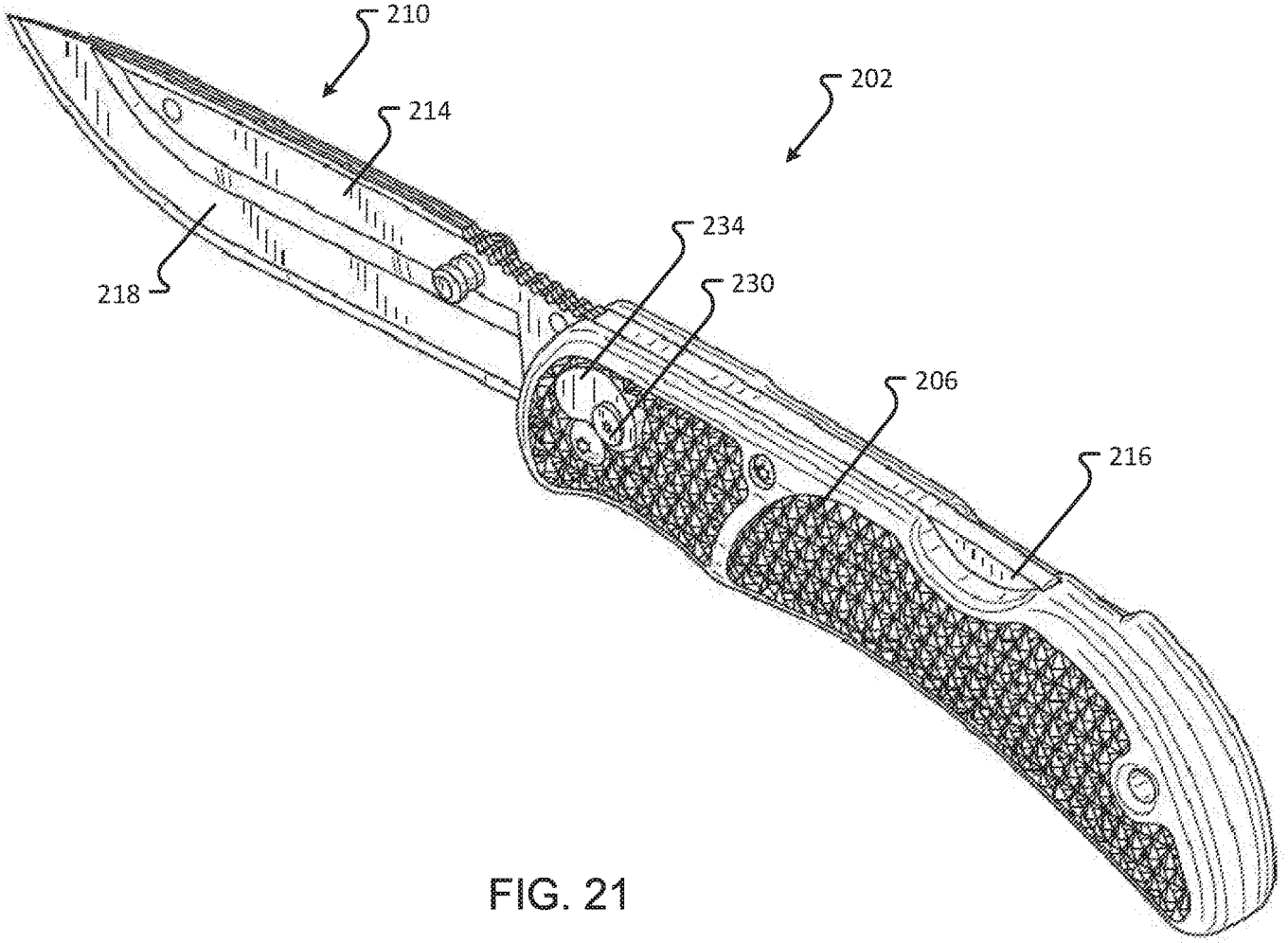
FIG. 21 is a perspective view of a folding knife with a replaceable blade of another embodiment of the present invention.
Figure 22:
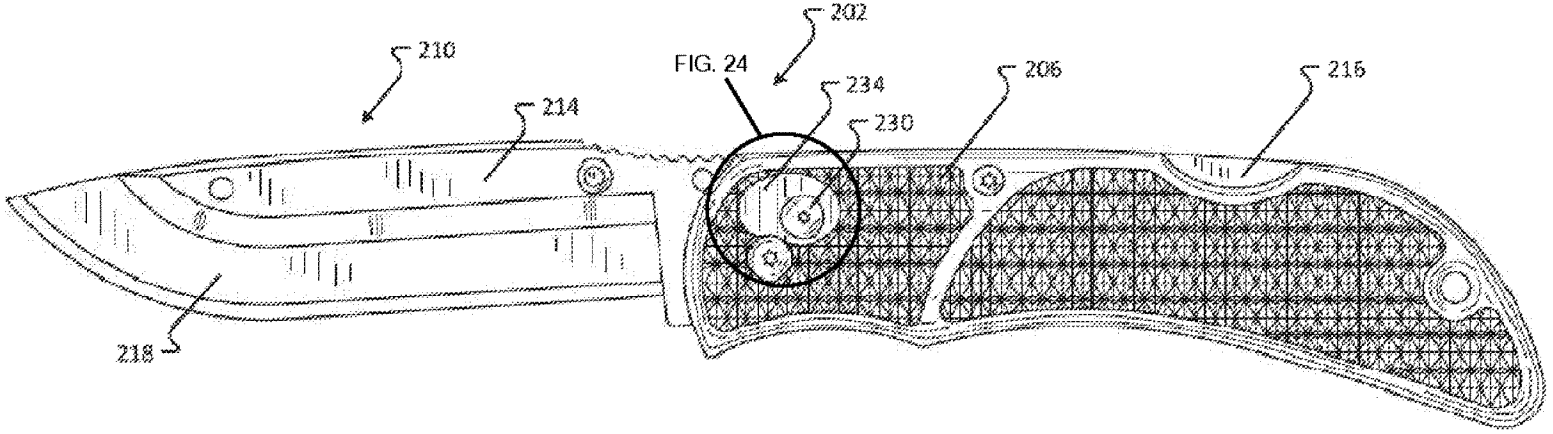
FIG. 22 is a front elevation view of FIG. 21.
Figure 23:
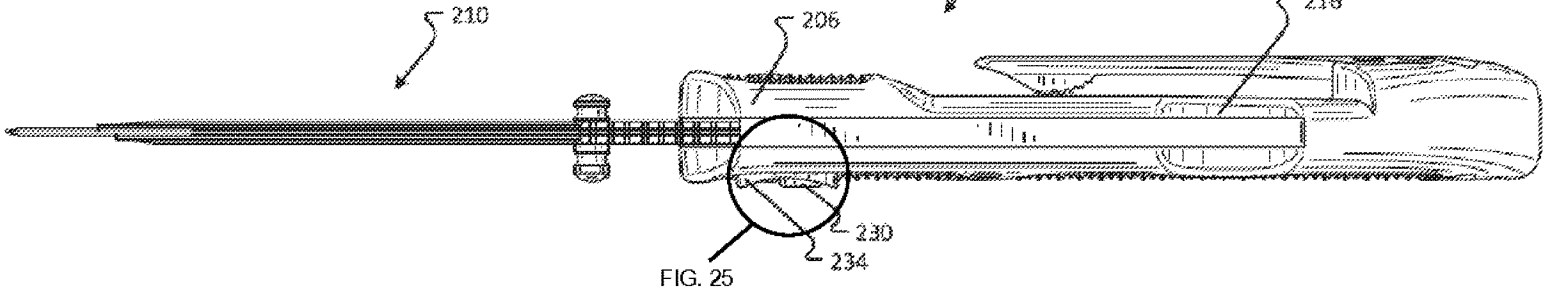
FIG. 23 is a top plan view of FIG. 21.

FIGS. 21-23 show a knife 202 of one embodiment of the present invention that includes a handle 206 that is operatively interconnected to a blade 210. The blade 210 is comprised of a blade carrier 214 that selectively receives a replaceable blade 218. Replaceable blade lock release button 230 is surrounded in this embodiment by a guard 234, which forms a raised ridge around replaceable blade lock release button 230. During use of the knife 202, the guard 234 protects replaceable blade lock release button 230 from accidental operation. More specifically, the raised ridge of guard 234 provides a surface can be easily felt by the user, such that the user can detect when his or her fingers or hands are in close proximity to replaceable blade lock release button 230 and exercise a heightened degree of caution. The surface texture of the guard 234 may also be different than the surface texture of the handle 206 and/or the replaceable blade lock release button 230. This allows a user to distinguish the guard 234 from the handle 206 and/or the replaceable blade lock release button 230, thus further enhancing the user's ability to determine, by touch, when a finger, hand, or other member is close to the replaceable blade lock release button 230, and thus to avoid accidental operation thereof. Additionally, portions of the guard 234 extend from the handle 206 by approximately the same distance that the replaceable blade lock release button 230 extends from the handle 206. As a result, a depressing force must be applied directly to the replaceable blade lock release button 230 to operate the button 230. If a finger, hand, or other member applies a depressing force not just to the replaceable blade lock release button 230 but also to the guard 234, then the guard 234, which is fixed and will not yield to the depressing force, will prevent the finger, hand, or other member from completely depressing the replaceable blade lock release button 230.

Figure 24:
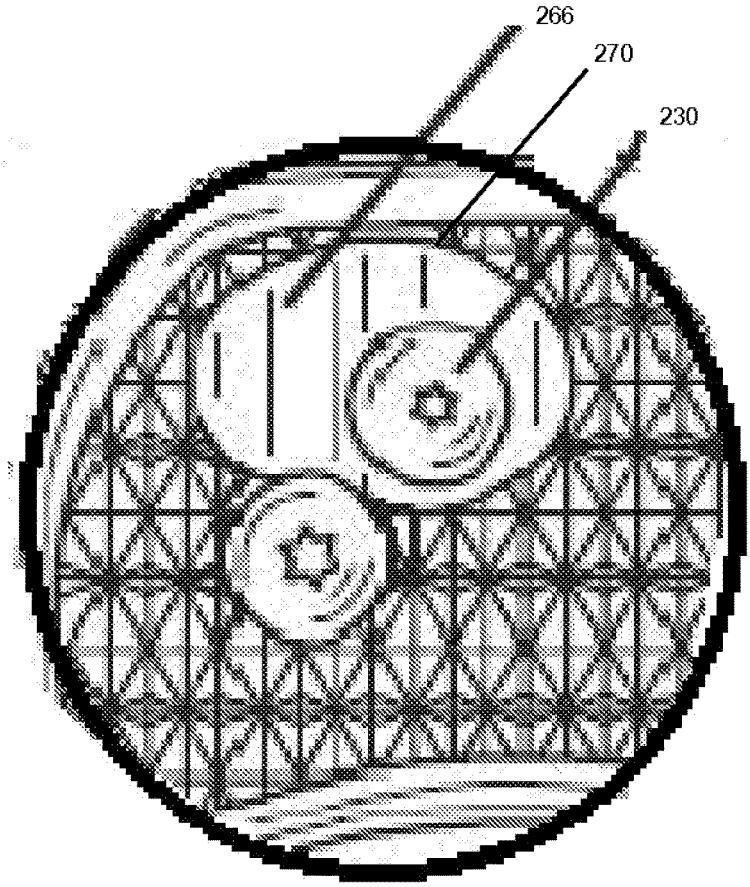
FIG. 24 is a detailed view of FIG. 22.
Figure 25:
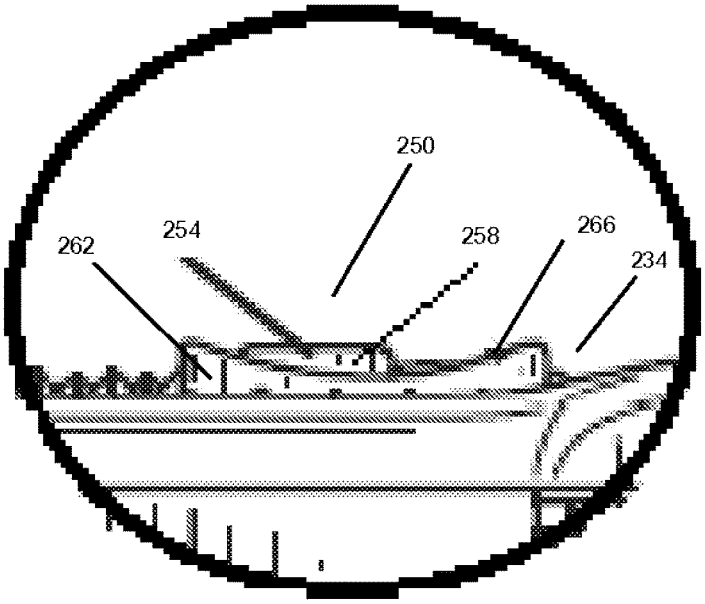
FIG. 25 is a detailed view of FIG. 23.

FIGS. 24 and 25 are detailed views of FIGS. 22 and 23, respectively. The replaceable blade release button 230 has a first end associated with a biasing member of the first blade liner portion end (see, for example, FIG. 15, reference number 158) and a second end 250 that extends from an outer surface of the handle 206, the second end 250 defined by a contact surface 254 with a perimeter wall 258 extending therefrom. The guard 234 is comprised of a wall 262 that extends from the outer surface of the handle 206 to a concaved surface 266, the concaved surface having a fabiform (i.e., bean-shaped) and non-planar outer edge 270. A first portion of the outer edge is located a first distance from the outer surface of the handle 206 and a second portion of the outer edge is located a second distance from the outer surface of the handle 206, wherein the first distance is greater than the second distance. Accordingly, the replaceable blade release button 230 is positioned within the outer edge 270 of the concaved surface 266 such that at least a portion of the perimeter wall 258 of the replaceable blade release button 230 is exposed.

As persons of ordinary skill in the art will recognize based on the foregoing disclosure, a guard 234 be utilized in any knife of an embodiment according to the present disclosure to guard against accidental or inadvertent depression of the replaceable blade lock release button 230. Persons skilled in the art will also recognize, based on the present disclosure, that a guard 234 may take many shapes, in addition to the shape depicted in FIGS. 21-23. In particular, the guard 234 may be, without limitation, circular, elliptical, triangular, square, or rectangular. The guard 234 may have straight edges, curved edges, or both. The guard 234 may form a raised ridge around the entirety of the replaceable blade lock release button 230, or around just a portion of lock release button 230. A ridge formed by the guard 234 may extend from the handle 206 of the knife 202 by the same distance as replaceable blade lock release button 230, or by a greater distance, or by a lesser distance. The ridge formed by the guard 234 may extend from the handle 206 a greater distance in some portions than in other portions. In some embodiments, the guard may be centered around the replaceable blade lock release button 230, while in other embodiments, the guard may not be centered around the replaceable blade lock release button 230. The guard 234 may be initially formed as part of the handle 206, or it may be formed separately and attached to the handle 206 via an adhesive (e.g. glue) or a fastener (e.g. a clip or screw). The guard 234 may be formed of the same material as the handle 206, or of a different material.

The blade of embodiments of the present invention is made out of high carbon or high carbon stainless steel and is approximately 2.5-4.0 inches (about 63.5-102 mm) long. The blade carriers are made of stainless steel and are spaced about 0.02-0.15 inches (about 0.55-3.8 mm) from each other. The blade carrier supports are made out of stainless steel or plastic however, one of skill in the art will appreciate that the replaceable blade, blade carriers, and blade supports may be made of any suitable material.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A knife, comprising:

a blade carrier having a first portion that is spaced from a second portion, the blade carrier being connected to a handle;

a first blade liner portion associated with the first portion of the blade carrier;

a second blade liner portion associated with the second portion of the blade carrier;

a replaceable blade positioned between the first blade carrier and the second portion of the blade carrier;

a replaceable blade release button having a first end associated with a biasing member of the first blade liner portion and a second end that extends from an outer surface of the handle, the second end defined by a contact surface with a perimeter wall extending therefrom;

a guard surrounding at least a portion of the replaceable blade release button, wherein the guard is comprised of a wall that extends from the outer surface of the handle to a concaved surface, the concaved surface having a fabiform and non-planar outer edge, wherein a first portion of the outer edge is located a first distance from the outer surface of the handle, wherein a second portion of the outer edge is located a second distance from the outer surface of the handle, the first distance being greater than the second distance, and wherein the replaceable blade release button is positioned within the outer edge of the concaved surface such that at least a portion of the perimeter wall of the replaceable blade release button is exposed; and a pin interconnected to the second portion of the blade carrier that is deflected to release the replaceable blade when the release button is depressed.

2. The knife of claim 1, wherein the blade carrier is rotatably interconnected to the handle.

3. The knife of claim 2, wherein the blade carrier is selectively lockable relative to the handle.

4. The knife of claim 2, wherein the handle is comprised of a first handle portion associated with the first blade liner portion and a second handle portion associated with the second blade liner portion, the first blade carrier having a channel that receives a portion of the blade lock release button.

5. The knife of claim 1, wherein the blade carrier is fixed relative to the handle.

6. The knife of claim 1, wherein the replaceable blade includes a hook on an upper edge thereof that selectively engages a member positioned between the first portion and the second portion of the blade carrier.

7. The knife of claim 1, wherein the replaceable blade includes an aperture that receives the pin.

8. The knife of claim 1, wherein the pin possesses a sloped surface.

9. The knife of claim 8, wherein the replaceable blade includes an end with a sloped surface that is adapted to engage the sloped surface of the pin.

10. The knife of claim 1, wherein the lock release button is moved in a lateral direction relative to a longitudinal axis of the knife, which generally corresponds to the length of the handle, to deflect the second portion of the blade carrier and to move the pin away from the replaceable blade.

11. The knife of claim 10, wherein the first portion of the blade carrier biases the lock release button away from the second portion of the blade carrier.

12. The knife of claim 1, wherein the replaceable blade is associated with the blade carrier in a direction generally parallel to the longitudinal axis of the knife, which generally corresponds to the length of the handle, and wherein the replaceable blade is not substantially rotated to affect interconnection with the blade carrier and to remove the replaceable blade from the blade carrier.

13. The knife of claim 1, wherein the first portion of the blade carrier is longer and wider than the second portion of the blade carrier.

14. A cutting tool having a blade carrier that is connected to a handle and selectively lockable relative thereto, a blade support associated with the carrier, and a replaceable blade selectively interconnected to the blade carrier, the improvement comprising:

a release button having a first end associated with a deflectable portion of the blade support and a second end that extends from an outer surface of the handle, the second end defined by a contact surface with a perimeter wall extending therefrom;

a guard surrounding at least a portion of the release button, wherein the guard is comprised of a wall that extends from the outer surface of the handle to a concaved surface, the concaved surface having a fabiform and non-planar outer edge, wherein a first portion of the outer edge is located a first distance from the outer surface of the handle, wherein a second portion of the outer edge is located a second distance from the outer surface of the handle, the first distance being greater than the second distance, and wherein the replaceable blade release button is positioned within the outer edge of the concaved surface such that at least a portion of the perimeter wall of the release button is exposed and a center point of the contact surface is not coincident with a center point of the outer edge;

a pin interconnected to the blade carrier and adapted to be received within an aperture of the replaceable blade that is deflected by the release button to release the replaceable blade; and wherein the replaceable blade includes a hook on an upper edge thereof that selectively engages a member integrated within the blade carrier, and wherein the replaceable blade is positioned within the blade carrier along a longitudinal axis of the blade carrier.

15. The cutting tool of claim 14, wherein the blade carrier is rotatably interconnected to and selectively lockable to the handle.

16. The cutting tool of claim 14, wherein the blade carrier is fixed relative to the handle.

17. The cutting tool of claim 14, wherein the pin possesses a sloped surface.

18. The cutting tool of claim 17, wherein the replaceable blade includes an end with a sloped surface that is adapted to engage the sloped surface of the pin.

19. A method of replacing a replaceable blade into a knife comprising a blade carrier having a first portion that is spaced from a second portion, the blade carrier being connected to a handle; a first blade support portion associated with the first blade carrier; a second blade support portion associated with the second portion of the blade carrier; a replaceable blade positioned between the first blade carrier and the second portion of the blade carrier; a replaceable blade release button having a first end associated with a deflectable portion of the first blade support portion and a second end that extends from an outer surface of the handle, the second end defined by a contact surface with a perimeter wall extending therefrom; a guard surrounding at least a portion of the replaceable blade release button, wherein the guard is comprised of a wall that extends from the outer surface of the handle to a concaved surface, the concaved surface having a fabiform and non-planar outer edge, wherein a first portion of the outer edge is located a first distance from the outer surface of the handle, wherein a second portion of the outer edge is located a second distance from the outer surface of the handle, the first distance being greater than the second distance, and wherein the replaceable blade release button is positioned within the outer edge of the concaved surface such that at least a portion of the perimeter wall of the replaceable blade release button is exposed; and a pin interconnected to the second portion of the blade carrier, comprising:

depressing the release button;

engaging an end of the release button onto the second portion of the blade carrier;

deflecting a portion of the second portion of the blade carrier;

removing the pin away from an aperture of the replaceable blade; and moving the replaceable blade from the blade carrier.

20. The method of claim 19, wherein the replaceable blade does not need to be rotated with respect to the blade carrier to remove and to lock the replaceable blade within the blade carrier.

21. The knife of claim 19, wherein the lock release button is moved in a lateral direction relative to a longitudinal axis of the knife, which generally corresponds to the length of the handle, to deflect the second portion of the blade carrier and to move the pin away from the replaceable blade.

22. The knife of claim 21, wherein the deflectable portion of the first blade support portion biases the lock release button away from the second portion of the blade carrier.

* * * * *